United States Patent [19]

Ferguson et al.

[11] Patent Number: 4,589,979

[45] Date of Patent: May 20, 1986

[54] UPGRADING HEAVY GAS OILS

[75] Inventors: Sam Ferguson, Sugar Land; Darrell D. Reese, Beaumont, both of Tex.

[73] Assignee: Nalco Chemical Company, Oak Brook, Ill.

[21] Appl. No.: 768,530

[22] Filed: Aug. 22, 1985

[51] Int. Cl.[4] ..... C10G 17/00; C10G 45/00

[52] U.S. Cl. ..... 208/263; 208/177

[58] Field of Search ..... 208/263

[56] References Cited

U.S. PATENT DOCUMENTS

| | | | |
|---|---|---|---|
| 2,152,720 | 4/1939 | Yabroff | 208/263 |
| 2,152,723 | 4/1939 | Yabroff | 208/263 |
| 2,279,277 | 4/1942 | Shoemaker | 208/263 |
| 2,424,158 | 7/1947 | Fuqua et al. | 208/263 |
| 2,701,783 | 2/1955 | Long et al. | 208/263 |
| 2,769,767 | 11/1956 | Fierce et al. | 208/263 |
| 2,769,768 | 11/1956 | Fierce et al. | 208/263 |
| 2,797,188 | 6/1957 | Carter et al. | 208/263 |
| 2,808,431 | 10/1957 | Fierce | 208/263 |
| 2,878,181 | 3/1959 | Ayers et al. | 208/263 |
| 2,956,946 | 10/1960 | King et al. | 208/263 |
| 3,176,041 | 3/1965 | Ayers et al. | 208/263 |

*Primary Examiner*—Andrew H. Metz
*Assistant Examiner*—Helane Myers
*Attorney, Agent, or Firm*—John G. Premo; Donald G. Epple; Anthony L. Cupoli

[57] ABSTRACT

A method of neutralizing the organic acidity in heavy gas oils to produce a neutralization number less than 1.0 whereby they are rendered suitable as lube oil feed stocks which comprises treating said heavy gas oils with a neutralizing amount of monoethanolamine to form an amine salt with the organic acids and then heating the thus-neutralized heavy gas oil at a temperature and for a time sufficient to convert the amine salts to amides.

2 Claims, No Drawings

UPGRADING HEAVY GAS OILS

INTRODUCTION

Heavy gas oils can be used either as asphalt or lube oil feed stocks. Frequently the heavy gas oil contains quantities of organic acids which render it not suitable for a lube oil feed stock. If it were possible to provide to the refining art a method for converting acidic heavy gas oils into lube oil feed stocks, an advance in the art would be afforded.

THE INVENTION

The invention comprises a method of neutralizing the organic acidity in heavy gas oils to produce a neutralization number less than 1.0 whereby they are rendered suitable as lube oil feed stocks which comprises treating said heavy gas oils with a neutralizing amount of monoethanolamine to form an amine salt with the organic acids and then heating the thus-neutralized heavy gas oil at a temperature and for a time sufficient to convert the amine salts to amides.

The amount of monoethanolamine necessary to produce neutralization of a heavy gas oil which has a neutralization number greater than 1.0 can best be determined by using titration techniques or by trail and error.

As indicated, after the amine has been added to the oil and salt formation occurs, the salts should be converted substantially to their amides. This can be done at temperatures about 25° F. greater than the boiling point of water for a period of time ranging over several days or higher temperatures can be employed and shorter reaction times used. Typically, if one were to heat the salt product at about 400°-500° F. for between 1-2 hours, the amide formation would take place.

EXAMPLE

In order to evaluate the invention, a virgin gas oil was selected from a refinery located in the southern part of the United States. The neutralization number of this gas oil was 3.88. The neutralization number was determined using the well known ASTM procedure D-974.

To determine the effectiveness of different amines at lowering the neutralization number, a weighed amount of the test vacuum gas oil and the additive were refluxed at between 450°-500° F. for 1.5 hours. This converted the salt formed by neutralization to the amide.

The corrosivity of the vacuum gas oil was determined by refluxing a weighed amount of VGO for six (6) hours at 500° F. with mild steel coupons immersed in the liquid. To measure the corrosivity after neutralization, a weighed amount of VGO and additive were refluxed at 450°-500° F. for 1.5 hours, then mild steel coupons were immersed in the liquid and the reflux continued for six (6) hours at 500° F.

Using the above test procedure, the results are presented below in the Table.

TABLE

| Additive | Concentration | Neutralization Number |
|---|---|---|
| Blank | — | 3.54 |
| Polyamine Bottoms | 1.43% | 2.45 |
| Polyamine Bottoms | 2.86% | 1.90 |
| Polyamine Bottoms | 6.0% | 1.20 |
| Tetraethylene Pentamine | 2.0% | 0.54 |
| Tetraethylene Pentamine | 1.0% | 0.82 |
| Monoethanolamine | 0.3% | 1.63 |
| Monoethanolamine | 0.45% | 1.22 |
| Monoethanolamine | 0.6% | 0.82 |
| | Corrosion Study | |
| Blank | | 42 mpy |
| 0.6% Monoethanolamine | | 22 mpy |

We claim:

1. A method of neutralizing the organic acidity in heavy gas oils to produce a neutralization number less than 1.0 whereby they are rendered suitable as lube oil feed stocks which consists essentially of treating said heavy gas oils with a neutralizing amount of monoethanolamine to form an amine salt with the organic acids and then heating the thus-neutralized heavy gas oil at a temperature at least about 25° F. greater than the boiling point of water and for a time sufficient to convert the amine salts to amides.

2. The method of claim 1 wherein the neutralized heavy gas oil is heated at a temperature of about 400°-500° F. for between 1-2 hours.

* * * * *